United States Patent [19]

Walkiewicz, Jr. et al.

[11] Patent Number: 4,712,459

[45] Date of Patent: Dec. 15, 1987

[54] APPARATUS FOR SEVERING WRAPPING FILM

[75] Inventors: Zigmunt J. Walkiewicz, Jr., Chagrin Falls; William C. Lynch, Brecksville, both of Ohio

[73] Assignee: Clamco Corporation, Cleveland, Ohio

[21] Appl. No.: 858,447

[22] Filed: May 1, 1986

[51] Int. Cl.[4] ..... B65H 59/02; B26D 7/10

[52] U.S. Cl. ..... 83/171; 83/16; 83/600; 83/175; 53/390; 53/66

[58] Field of Search ..... 83/171, 16, 600, 175; 53/556, 64, 66, 116, 390; 192/45; 271/51

[56] References Cited

U.S. PATENT DOCUMENTS

| | | | |
|---|---|---|---|
| 1,437,843 | 12/1922 | Heinrichs | 271/51 |
| 2,569,108 | 9/1951 | Koch | 192/45 X |
| 4,014,229 | 3/1977 | Lynch | 83/171 X |
| 4,501,106 | 2/1985 | Treiber et al. | 53/66 |

*Primary Examiner*—Donald R. Schran

*Attorney, Agent, or Firm*—Tarolli, Sundheim & Covell

[57] ABSTRACT

A wrapping film severing apparatus is disclosed for use in severing sheets of film from a roll of plastic film. The roll of film is supported so that it may rotate about its axis of rotation while film is being withdrawn from the roll. A braking force is applied to the roll so that the film is under tension as it is being withdrawn from the roll. An electrically heated cutoff element is located forwardly of the roll for use in severing a sheet of film from the roll as a length of film is withdrawn under tension from the roll and then brought into contact with the cutoff element. The film is threaded through a pair of pinch rollers extending transversely of the film path and located intermediate the film roll and the cutoff element for guiding movement of the film from the roll to the cutoff element. A one-way clutch is associated with at least one of the rollers permitting forward movement of the film toward the cutoff element while restricting backward movement toward the film roll.

9 Claims, 3 Drawing Figures

APPARATUS FOR SEVERING WRAPPING FILM

BACKGROUND OF THE INVENTION

This invention relates to wrapping machinery for use in wrapping objects with thermoplastic film, such as polyvinyl chloride wrapping film, and, more particularly, to machinery for dispensing and severing sheets from a roll of such film.

It is known in the art to provide a wrapping apparatus in which film is withdrawn from a roll of film and then placed over a hot wire cut off for use in severing the film during the process of wrapping articles therein. Such apparatus is frequently employed in supermarkets for wrapping meats, vegetables, and the like prior to placing the wrapped items on display counters. In some attempts in the prior art, the hot wire was maintained at a temperature on the order of 700° F. in order to effect satisfactory severance of the film. However, operating at such high temperatures caused the film to melt in such a manner as to generate obnoxious fumes. This lead to improvements in the art to achieve a severing operation while reducing the fumes. One attempt in the prior art is found in the U.S. Pat. No. 3,754,489 to H. Carver. This patent proposes that the film be severed by means of a rectangular cutoff element which is heated to a temperature in the range of 325° F. to 350° F., which is at or slightly above the melting point of the plastic film. The rectangular cutoff element is maintained at a substantially constant temperature along the line of cutoff during the severing operation by means of a substantial mass which provides a heat sink to maintain a constant temperature during severing.

Another approach in the industry has taken the form of the U.S. Pat. No. 4,014,229, to W. Lynch, assigned to the same assignee as the invention herein and the disclosure of which is herein incorporated by reference. In Lynch, supra, the cutoff element takes the form of a metal tube having an internal electrical heating element which is electrically insulated from the tube and which heats the cutoff element to a temperature on the order of 240° F. to 260° F. which is below the melting point of the plastic film. The cutoff element preferably has a corner edge extending transversely of the path of movement of the film and this corner edge serves to concentrate stresses applied to the film along the line of severance to assist in severing the film from the film roll. The cutoff element is associated with a thermostat, which senses the temperature of the cutoff element and switches the electrical power to the heating element contained therein in dependence upon the sensed temperature.

A problem noted in the operation of such prior art film dispensing and severing apparatus is that, after the film has been severed, the leading edge of the remaining film may lie against the cutoff element. If there is a substantial period of time between successive severing operations, this leading edge will tend to melt and leave a plastic coated deposit on the cutoff element. This deposit detracts from the appearance of the cutoff element and provides a dull corner edge on the cutoff element. More importantly, however, this plastic coated deposit will add a layer of insulation on the cutoff element, decreasing the thermal efficiency of the cutoff element. Therefore, it is desirable that after each severing operation, the leading edge of the remaining film should back away from the cutoff element a sufficient distance so that it will not tend to melt and leave deposits on the cutoff element and will not provide fumes. To some extent this can be achieved in the apparatus disclosed in Lynch by applying a braking force to the roll of plastic film so that the film is under tension as it is being withdrawn from the roll. After the severing operation, the leading edge will then back up toward the roll. However, depending upon the amount of braking force applied to the roll, the film will rapidly snap back toward and gather about the roll resulting in the need for rethreading the leading edge of the film. This results in down time, which should be avoided in the operation of such a wrapping apparatus.

The present invention proposes that a pair of pinch rollers be located intermediate the roll of film and the cutoff element for guiding the passage of the film to the cutoff element. Further, the present invention proposes that a one-way clutch be associated with at least one of the pinch rollers to prevent the film, after severance, from rapidly backing up and gathering about the film roll. Such a construction, then, permits a severing operation with a heated cutoff element without creating fumes and without the film tending to melt and provide plastic deposits on the cutoff element.

It is, however, known in the art to provide a film wrapping machine having pinch rollers located intermediate the roll of film and a cutoff element. Such is illustrated in the patent to F. Treiber, U.S. Pat. No. 4,501,106. Specifically, Treiber, supra, discloses pinch rollers including a roller 370 which is described in the patent at column 12, lines 31–35 as including a one-way clutch to allow rotation only in a clockwise direction, as shown in FIG. 12 of the patent. It should be noted, however, that whereas Treiber, supra, discloses pinch rollers having a one-way clutch, they are not employed in a wrapping apparatus using an electrically heated cutoff element as in the case of Lynch, supra. Instead, Treiber, supra, employs a mechanical cutoff knife, as is shown in FIG. 6 of the patent. Consequently, Treiber is not concerned with the need for ensuring that the leading edge of the film does not lie against the cutoff element which would result in obnoxious fumes or in which the film would tend to melt and leave deposits on the cutoff element as discussed hereinabove.

SUMMARY OF THE INVENTION

It is a primary object to provide an improved wrapping film dispenser and cutoff apparatus to achieve operation with a heated cutoff element, while at the same time preventing the leading edge of the film from resting against the cutoff element to cause fumes or film deposits on the cutoff element.

It is a still further object of the present invention to provide such an improved apparatus wherein the film, after being severed, will not back up upon the film roll resulting in down time as the film is being rethreaded or the like.

In accordance with the present invention, there is provided apparatus for severing sheets of film from a roll of plastic film wherein the roll of film is supported as it rotates about its axis of rotation while film is being withdrawn from the roll. A braking force is applied to the roll so that the film is under tension as it is being withdrawn from the roll. An electrically heated cutoff element is located forwardly of the roll for severing a sheet of film from the roll as a length of film is withdrawn under tension from the roll and then brought into contact with the cutoff element. A pair of pinch rollers extend transversely of the path of the film removal and are located intermediate the film roll and the cutoff element for guiding movement of the film between the rollers from the film roll to the cutoff element. A one-way clutch means is associated with at least one of the pinch rollers for permitting forward movement of the film toward the cutoff element, while at the same time restricting backward movement of the film toward the roll.

BRIEF DESCRIPTION OF THE DRAWINGS

The foregoing and other objects and advantages of the invention will become more readily apparent from the following description of the preferred embodiment of the invention as taken in conjunction with the accompanying drawings which are a part hereof and wherein.

DESCRIPTION OF PREFERRED EMBODIMENT

Figure 1:
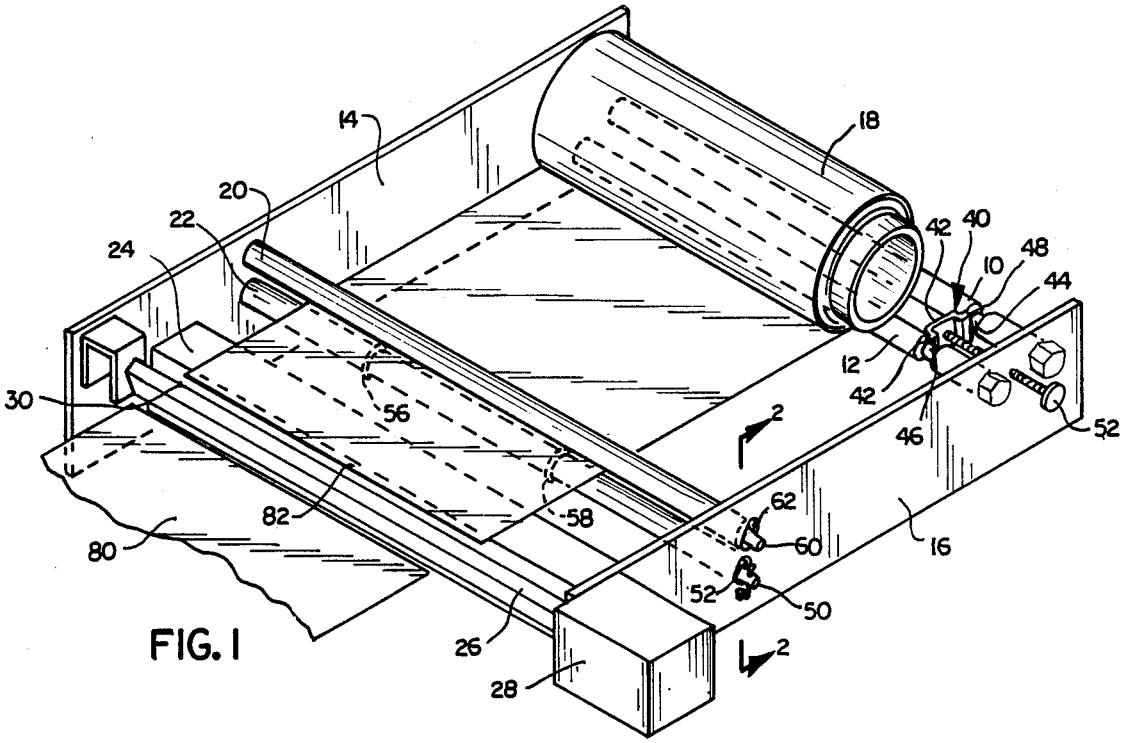
FIG. 1 is a fragmentary orthogonal view showing the improved film dispenser and cutoff apparatus of the present invention.

Reference is now made to the drawings wherein the showings are for purposes of illustrating a preferred embodiment of the invention only and not for purposes of limiting same. The wrapping apparatus as illustrated in FIG. 1 includes a pair of rollers 10 and 12 suitably journalled in side walls 14 and 16 for rotatably supporting a film roll 18 as it rotates about its axis of rotation while the film is being withdrawn from the roll. Preferably, the roll is positioned on the rollers so that film is withdrawn from the underside of the roll, as is illustrated in FIG. 1. Film being withdrawn from the roll is fed through a pair of nip or pinch rollers 20 and 22 carried by the side walls 14 and 16. The film is then directed beyond the rollers in a forward direction to a worktable 24 suitably mounted at opposite ends to side walls 14 and 16. The worktable may serve as a wrapping table for articles to be wrapped by film withdrawn from roll 18. An electrically heated cutoff element 26 is located forwardly of the worktable 24 and extends between walls 14 and 16. In operation, the operator pulls a length of film from the roll 18 through the rollers 20 and 22 and then wraps an article with the film, using the table 24. Thereafter, the operator pulls the film wrapped article in a forward direction and severs the film behind the wrapped article by directing the film downwardly over the cutoff element 26 to effect severance.

The cutoff element 26 may take a form well known in the prior art, such as a hot wire cutoff operated at a high temperature on the order of 700° or may take the form of the rectangular cutoff element disclosed in the patent to Carver, supra, which operates at a somewhat lower temperature on the order of 325° F. to 350° F. Preferably, however, the cutoff element 26 takes the form as illustrated in the patent to Lynch, supra, which preferably operates at a temperature below the melting point of the plastic film and this operating temperature is on the order of 240° F. to 260° F. The cutoff element 26 is described in greater detail in the patent to Lynch, supra, the disclosure which is incorporated herein by reference. This cutoff element takes the form of a hollow rectangular shaped element having an electrically insulated heating element therein which extends substantially the full length of the cutoff element between the side walls 14 and 16 to which the element is secured. A thermostat is located in a housing 28 mounted to the side wall 16. The thermostat preferably takes the form of a bimetallic switch and has a heat sensitive element which is clamped to the cutoff element 26 so as to provide efficient heat transfer between the cutoff element and the thermostat. The thermostat serves to energize and de-energize the heating element located within the cutoff element in dependence upon the temperature of the cutoff element so as to maintain its temperature in the range of approximately 240° F. to 260° F.

The cutoff element 26 is preferably of rectangular cross section and is mounted between the side walls 14 and 16 in a canted fashion so that a cutoff edge 30 faces vertically upward, the cutoff edge being defined by side walls which divert from each other at an angle on the order of 90°. The corner or cutoff edge functions to concentrate the stresses applied to the film substantially along a line of severance to assist in the severing operation even though the temperature of the cutoff element is preferably below that of the melting point of the plastic film.

A drag brake 40 is employed for purposes of supplying a braking force to the film roll so that film must be withdrawn from the film roll against the braking resistance causing tension in the film. Sufficient tension is provided so that the film may be severed by downward movement against the cutoff element 28 without the film being drawn from the film roll during the severing operation. Additionally, the braking force serves to prevent film overrun when the film is being withdrawn from the roll and particularly so when it is being withdrawn at a rapid rate.

As best seen in FIG. 1, the drag brake 40 includes a bracket 42 having end portions 44 and 46 received in circumferential grooves 48 and 49 in rollers 10 and 12, respectively. These end portions 44 and 46 of the bracket 42 bear against the sides of the grooves 48 and 49, respectively, to apply a frictional drag force against the rollers to prevent the rollers from rolling freely. This brake force or drag force is adjustable by turning a threaded member 52 which threads through the supporting side wall 16 and is fixed to the bracket 42 so as to be rotatable therein, but constrained against axial movement relative thereto. The threaded member 52 may be rotated in the threaded aperture in the side wall 16 to adjust the frictional drag applied by the bracket 42.

The pinch rollers 20 and 22 extend between and are journaled for rotation in the side walls 14 and 16. The lower roller 22 has a shaft 50 extending therethrough and the shaft extends beyond each end of the roller with the extended ends being journaled in circular openings in the opposing side walls, such as the circular opening 52 in side wall 16. These openings are sufficient to accommodate the shaft 50 while preventing axial dislodgement of the roller. The lower roller 22 also carries a pair of O-rings 56 and 58 mounted midway between the side walls 14 and 16 and positioned so as to engage the lower surface of plastic film being withdrawn from the film roll 18. The upper roller 20 overlies the film and is provided with a shaft 60 which extends through the roller and is journalled at its opposite ends in slots provided in the side walls 14 and 16. As is shown in FIG. 1, these slots include a slot 62 in side wall 16 with the slot extending at substantially a 45° angle with respect to vertical by a sufficient distance to permit the upper roller 20 to move up and down somewhat as film is being advanced between the rollers. During operation, the upper roller will, under the force of gravity, lay on top of and engage the upper surface of the film so that the film is pinched between the O-rings 56 and 58 and the upper roller 20. The upper roller 20 is a hollow cylindrical tube which coaxially surrounds shaft 60 and is supported thereabout by means of roller bearings 68 located at each end of the tube with the roller bearing being press fit between the shaft 60 and the inner surface of roller 20. The upper roller 20 may freely rotate about its axis in either a clockwise or counterclockwise direction, as viewed in FIG. 3.

Figure 2:
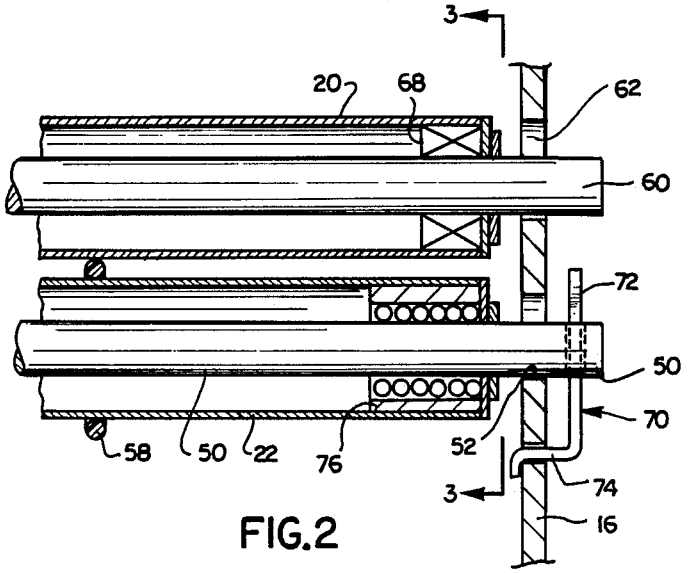
FIG. 2 is an enlarged sectional view with parts broken away illustrating the pinch rollers of FIG. 1 in greater detail.
Figure 3:
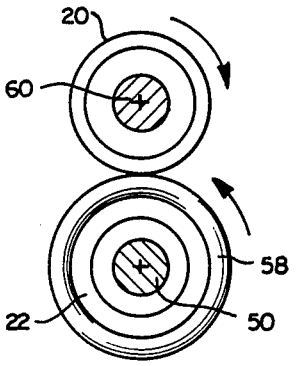
FIG. 3 is a view taken along line 3—3 looking in the direction of the arrows of FIG. 2.

The lower roller 42 also includes a tubular sleeve which coaxially surrounds shaft 50. The shaft 50 is prevented from rotating about its axis by suitable means. This, for example, may take the form of an L-shaped pin 70 having an elongated leg 72 extending through shaft 50 and a shorter leg portion 74 extending at right angles into the suitable aperture in side wall 16. The roller 22 rotates about shaft 50 in a counterclockwise direction, as is illustrated in FIG. 3, but is restrained from movement in a clockwise direction by means of a one-way clutch arrangement. A suitable clutch arrangement may take the form of a needle bearing one-way clutch provided by Torrington Bearing Company and known as their one-way clutch model RCO40708. Such a one-way clutch 76 is illustrated in FIG. 2 as being press fit into one end of roller 22. The other end of the roller may be provided with a suitable roller bearing corresponding with bearing 68 on roller 20, as it has been found that a one-way clutch need only be mounted on one end of the roller. This restricts the roller 22 from rotation in a clockwise direction, as viewed in FIG. 3, to a limited extent, such as on the order of 15° of rotation.

As the operator withdraws film from the film roll 18, the film passes in a forward direction through the rollers and is pulled sufficiently forward so that a sheet 80 may be severed from the film roll by means of the cutoff element 26. As this occurs, the tension is released and the leading edge 82 of the film withdraws in a backward direction away from the cutoff element 26 so as to rest on the table 24. The leading edge 82 is then located remote from the cutoff element 26 so that there is no contact therebetween which would result in the tendency for the plastic film to melt and leave insulating deposits on the cutting edge 30 thereof. Additionally, as a sheet 80 is severed from the film, the remaining portion of the film tends to backup toward the roll 18 due to the braking force applied to the roll by the drag brake 40. However, the film is prevented from bunching up or otherwise gathering on the roll 18 because of the one-way clutch arrangement associated with the lower roll 22 which restricts backward movement of the film. This eliminates the need to rethread the film through the pinch rollers after the severing operation and, hence, reduces down time of the wrapping apparatus.

Whereas the one-way clutch has been disclosed herein as being a needle bearing one-way clutch, it is to be appreciated that other forms of one-way clutches may be employed. For example, a ratchet and pinion mechanism may be installed on shaft 50 to interplay with the roller 22 to restrict backward movement of the roller.

While the invention has been described in conjunction with a preferred embodiment, it is to be appreciated that various modifications may be made without departing from the spirit and scope of the invention as defined by the appended claims.

Having described a specific preferred embodiment of the invention, the following is claimed:

1. Apparatus for severing sheets of film from a roll of plastic film, comprising:

means for supporting a said roll as it rotates about its axis of rotation while film is being withdrawn from said roll;

means for applying braking force to said roll so that said film is under tension as it is being withdrawn from said roll;

electrically heated cutoff means located forwardly of said roll for severing a sheet of film from said roll as a length of film is withdrawn under tension from said roll and then brought into contact with said cutoff means; and, a pair of pinch rollers extending transversely of the path of said film and located intermediate said roll support means and said cutoff means for guiding movement of said film between said rollers from said roll to said cutoff means, one-way clutch means associated with at least one of said rollers for permitting forward movement of said film therebetween toward said cutoff means while restricting backward movement toward said roll, resulting from the severing of a said sheet, by a controlled amount sufficient to ensure that the leading edge of the remaining film moves off and away from said heated cut off means sufficient to prevent melting of said film while at the same time preventing said film from backing up by an amount to cause said film to bunch up on or gather on said roll.

2. Apparatus as set forth in claim 1 wherein said one-way clutch means provides restricted backward movement of less than 15° of angular rotation of at least one of said rollers.

3. Apparatus as set forth in claim 1 wherein said one-way clutch means is carried by at least one of said pinch rollers.

4. Apparatus as set forth in claim 1 wherein said means for applying braking force to said roll includes means for adjusting the magnitude of said braking force.

5. Apparatus as set forth in claim 1 wherein only one of said pinch rollers carries a said one-way clutch means.

6. Apparatus as set forth in claim 5 wherein said one pinch roller carries only a single said one-way clutch means.

7. Apparatus as set forth in claim 5 wherein said one pinch roller includes an elongated cylindrical tube coaxially surrounding a stationary shaft for rotation thereabout.

8. Apparatus as set forth in claim 7 wherein said clutch means is interposed between said cylindrical tube and said shaft at one end of said roller and is secured in place therebetween.

9. Apparatus as set forth in claim 8 wherein said clutch means is secured in place between said cylindrical tube and said shaft by a press fit.

* * * * *